US007128036B2

(12) United States Patent
Suzuki

(10) Patent No.: US 7,128,036 B2
(45) Date of Patent: Oct. 31, 2006

(54) AUTOCHOKE CONTROLLER

(75) Inventor: Masashi Suzuki, Shizuoka-ken (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 70 days.

(21) Appl. No.: 10/477,380

(22) PCT Filed: Oct. 18, 2002

(86) PCT No.: PCT/JP02/10823

§ 371 (c)(1),
(2), (4) Date: Apr. 30, 2004

(87) PCT Pub. No.: WO03/036078

PCT Pub. Date: May 1, 2003

(65) Prior Publication Data

US 2004/0169295 A1 Sep. 2, 2004

(30) Foreign Application Priority Data

Oct. 22, 2001 (JP) ..... 2001-323990

(51) Int. Cl.
*F02D 9/10* (2006.01)
*F02D 41/06* (2006.01)
*F02M 1/10* (2006.01)

(52) U.S. Cl. ..... 123/179.18; 261/39.2

(58) Field of Classification Search ..... 261/39.2, 261/39.6; 123/179.15, 179.16, 179.18, 339.24
See application file for complete search history.

(56) References Cited

U.S. PATENT DOCUMENTS 4,561,394 A * 12/1985 Kishida et al. ..... 123/587
5,378,411 A * 1/1995 Iwaki et al. ..... 261/39.2

FOREIGN PATENT DOCUMENTS

| | | |
|---|---|---|
| JP | 54-003621 | 1/1979 |
| JP | 54-153923 | 12/1979 |
| JP | 2-191866 | 7/1990 |

* cited by examiner

*Primary Examiner*—Stephen K. Cronin
*Assistant Examiner*—Arnold Castro
(74) *Attorney, Agent, or Firm*—Hogan & Hartson LLP

(57) ABSTRACT

An auto-choke control device maintains good startability at the time of restarting at high temperature without need of a thermostat specific for an auto-choke. An engine temperature detection device is drivably controlled by a control circuit in response to the engine temperature. A switching detection circuit detects ON or OFF operation of a main switch connected to the control circuit. A self-hold circuit automatically holds power to the control circuit when the main switch is changed from an ON state to an OFF state.

3 Claims, 3 Drawing Sheets

Prior Art

AUTOCHOKE CONTROLLER

FIELD OF THE INVENTION

This invention relates to an auto-choke control method for an engine.

BACKGROUND OF THE INVENTION

An auto-choke has been used to improve startability of an engine. A hot wax type auto-choke is known as such an auto-choke. This hot wax type auto-choke comprises a heater in wax, and the wax is expanded/contracted by ON/OFF operation of the heater so that a valve is opened/closed gradually in response to the expansion/contraction of the wax. Such a hot wax type auto-choke is provided in a bypass passage, which is provided, for example, additionally in a throttle body of a fuel injection engine, and adapted to open a valve at starting of the engine prior to warming up to increase the amount of intake air for the enhancement of startability.

FIG. 4 is a block diagram of a conventional hot wax type auto-choke control device.

In an engine control unit (ECU) 51 mounted to a vehicle is provided a control circuit 52 constituting a CPU such as a microcomputer, which is connected to a heater 54 of the auto-choke through a drive circuit 53. In the ECU 51 is provided a power circuit 57 connected to a battery 56 through a main switch 55. The power circuit 57 supplies a drive power from the battery 56 to the control circuit 52 and other electronic control parts or electric circuits and the like when the main switch 55 is turned ON.

Between the heater 54 and the battery 56 is connected a thermostat (engine temperature switch) 58 being set ON/OFF in response to the engine temperature, by which energization from the battery 56 to the heater 54 is ON/OFF in response to the engine temperature.

The heater 54, when energized (at the time of ON), expands the wax, causing a valve to be closed and volume increase of intake air to be shut off, and when energization is shut off (at the time of OFF), contracts the wax, causing the valve to be opened and the amount of intake air is increased.

In such an auto-choke described above, before engine starting, the heater 54 is in an OFF state and the valve of the auto-choke is opened.

If the main switch 55 is turned ON at the time of engine starting, a power source voltage is supplied to the control circuit 52. At this time, with the heater 54 kept in an OFF state and the valve opened, the amount of intake air is increased to enhance startability. When the engine is started, the control circuit 52 sets the heater 54 ON through the drive circuit 53 to close the valve gradually to thereby shut off volume increase of intake air, and performs fuel injection by ordinary running control. When the engine temperature is raised as a result of engine operation, the thermostat 58 is set ON.

Here, if after the main switch 55 is turned OFF to stop the engine, the main switch 55 is turned ON again to start the engine while the engine temperature is high, the heater 54 remains ON because of the thermostat 58 being ON, so that the valve of the auto-choke is kept closed without volume increase of intake air and engine starting at high temperature can be performed smoothly (without the thermostat 58, when the main switch is OFF, the heater 54 is also set OFF and the valve is kept open at the time of restarting at high temperature, so that the amount of intake air is increased in spite of high engine temperature, worsening startability).

However, in the conventional auto-choke control device, a special thermostat is required for the start control of an engine at the time of restarting at high temperature and the thermostat is mounted to a body separate from an ECU, so that the number of parts is increased, resulting in a restriction on layout and raising costs.

In view of the foregoing, an object of this invention is to provide an auto-choke control device capable of maintaining a good startability at the time of restarting at high temperature with a simple construction and without need of using a thermostat specific for an auto-choke, and preventing cost increase.

DISCLOSURE OF THE INVENTION

In order to achieve the foregoing object, this invention provides an auto-choke control device having engine temperature detection means connected to a control circuit and adapted to be drivably controlled through said control circuit in response to the engine temperature, wherein a switching detection circuit for detecting ON or OFF operation of said main switch is connected to said control circuit and a self-hold circuit is provided for automatically holding power to said control circuit when said main switch is changed from an ON state to an OFF state.

According to the invention of this arrangement, regarding the auto-choke operating in response to the engine temperature, when the main switch is changed to an OFF state and the engine is stopped, power to the control circuit is automatically held, so that control of the auto-choke operation can be continued by the control circuit. Therefore, the auto-choke can be maintained by the control circuit in a state in which it has been before engine stoppage until the engine temperature detected by the temperature detection means falls to a given value or lower. As a result, if the engine is restarted while the engine temperature is high after the engine stoppage, an opening state of the auto-choke can be avoided, preventing a drop in startability. Such temperature detection means (for example, a cooling water temperature sensor) is provided originally for the drive control of the fuel injection engine, and the switching detection circuit and the self-hold circuit can be easily incorporated in the same unit (ECU) as the control circuit, with a simple construction and without need of increasing its shape. Therefore, the auto-choke can be controlled properly at the time of restarting of the engine for the enhancement of startability, without need of using an expensive thermostat provided separate from a control circuit unit and having a complex construction around the engine as in the prior art, and with a small sized simple construction.

In a preferred arrangement, this invention is characterized in that said auto-choke is a hot wax type auto-choke having wax expanding or contracting according to ON or OFF operation of a heater and said heater is adapted to be drivably controlled by said control circuit.

According to the invention of this arrangement, when in a hot wax type auto-choke of a simple construction, an engine is started at a high temperature at which wax is expanded, the heater can be controlled properly, preventing a drop in startability of the engine at the time of restarting at high temperature.

In another preferred arrangement, this invention is characterized in that said control circuit automatically shuts off power after a lapse of a predetermined time after said main switch is changed to an OFF state.

According to the invention of this arrangement, in the event of failure of engine temperature detection means, for example, power supply of the control circuit is automatically shut off after a lapse of a predetermined time after the main switch is turned OFF, therefore excessively long energization by a self-hold circuit is prevented, avoiding inappropriate operation or battery exhaustion due to long energization.

BEST MODE FOR CARRYING OUT THE INVENTION

An embodiment of the present invention will be described below with reference to the accompanying drawings.

Figure 1:
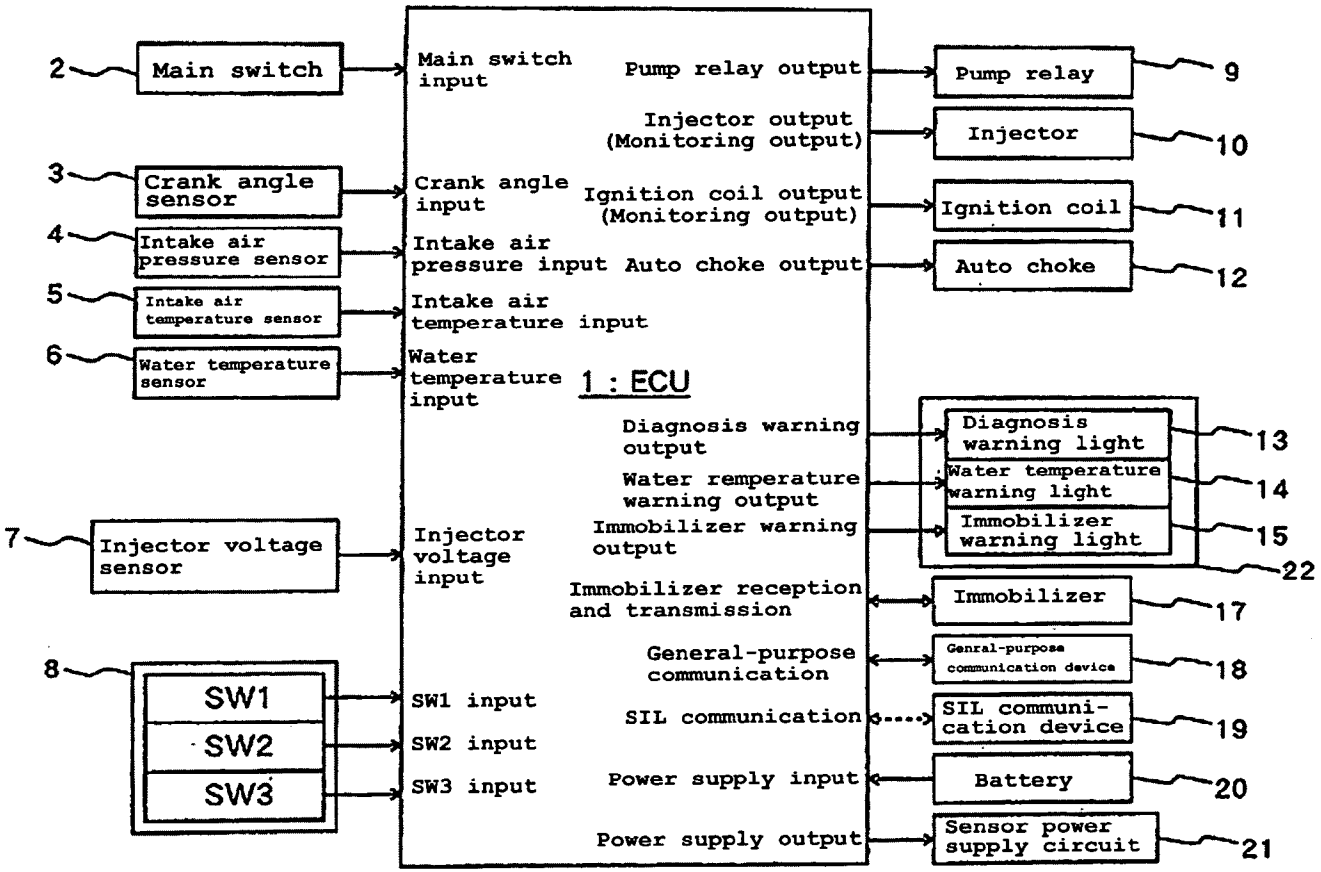
FIG. 1 is a block diagram of an entire control system of a motorcycle according to the present invention.

FIG. 1 is a block diagram of an entire control system of a motorcycle according to the embodiment of the present invention.

An engine control unit (ECU) 1 is unitized to be an integral component. A control circuit CPU (not shown) of the ECU 1 receives inputs including an on/off signal from a main switch 2, a crank pulse signal from a crank angle sensor 3, an intake airpressure detection signal from an intake airpressure sensor 4, an intake air temperature detection signal from an intake air temperature sensor 5, a cooling water temperature detection signal from a water temperature sensor 6, a voltage signal from an injector voltage sensor 7 for controlling an injector, and a checking input signal from a switch box 8 having a plurality of switches SW1 to SW3. The ECU 1 is also connected to a battery 20, from which battery power supply is inputted.

For outputs from the ECU 1, the ECU 1 outputs a pump relay output signal to a pump relay 9 for driving a fuel pump, an injector output signal for driving an electromagnetic coil of an injector 10, an ignition coil output signal for driving an ignition coil 11, an automatic choke output signal for driving an automatic choke 12 in response to cooling water temperature, a diagnosis warning signal for driving a diagnosis warning lamp 13 in a meter 22 when abnormality is detected, a water temperature warning signal for driving a water temperature warning lamp 14 to indicate a warning when the cooling water temperature exceeds a given temperature, and an immobilizer warning signal for driving an immobilizer warning lamp 15 when an immobilizer 17 of an engine key or the like is abnormally operated. Power supply voltage is outputted for supplying power to each sensor either through a sensor power supply circuit 21 or directly.

The ECU 1 is also connected to an external general purpose communication device 18 and capable of inputting/outputting control data or the like through a general purpose communication line. The ECU 1 is further connected to a serial communication device 19 and capable of handling serial communication.

Figure 2:
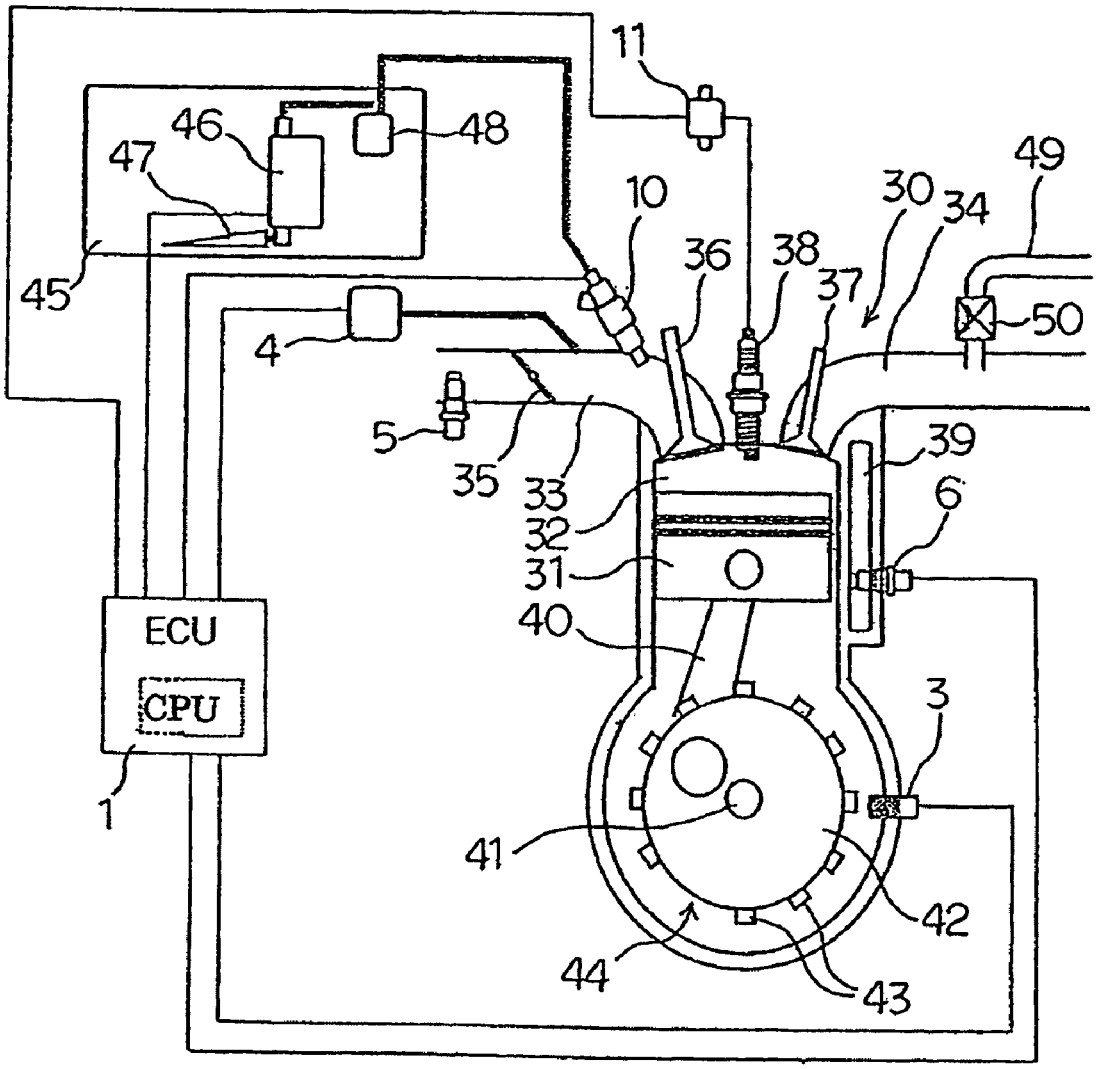
FIG. 2 is a schematic diagram of a crank angle detection apparatus for an engine according to the present invention.

FIG. 2 is a system structure diagram of a crank angle detection device according to the embodiment of the present invention.

A single-cylinder four-stroke engine 30 is formed with a combustion chamber 32 on top of a piston 31. An intake pipe 33 and an exhaust pipe 34 are connected to the combustion chamber 32 so as to communicate with the combustion chamber 32. A throttle valve 35 is provided in the intake pipe 33, and an intake valve 36 is disposed at an end thereof. An exhaust valve 37 is provided at an end of the exhaust pipe 34. A reference numeral 38 denotes an ignition plug. A cooling jacket 39 is provided around a cylinder of the engine 30, to which the water temperature sensor 6 is attached. The piston 31 is connected to a crankshaft 41 via a connecting rod 40.

A ring gear 42 is integrally secured to the crankshaft 41. The outer periphery of the ring gear 42 has plural teeth (projections) 43 formed at equal intervals, among which one toothless portion (irregular interval portion) 44 is provided. The crank angle sensor (crank pulse sensor) 3 is provided for detecting the teeth 43 formed on the ring gear 42. The crank angle sensor 3 detects each tooth 43 to generate a pulse signal having a pulse width that corresponds to a lateral length on the upper side of the tooth. In this example, 12 portions to be each provided with the tooth 43 include one toothless portion 44 so that the sensor generates 11 (eleven) pulse signals one per 30° of one crank rotation.

The injector 10 is attached to the intake pipe 33. Fuel pumped from a fuel tank 45 through a filter 47 using a fuel pump 46 is delivered to the injector 10 under a constant fuel pressure maintained by a regulator 48. The ignition coil 11 controlled by the ECU 1 (FIG. 1) is connected to the ignition plug 38. The intake air pressure sensor 4 and the intake air temperature sensor 5 are attached to the intake pipe 33, which are separately connected to the ECU 1.

A secondary air introducing pipe 49 for cleaning exhaust gas is connected to the exhaust pipe 34. An air cut valve 50 is provided on the secondary air introducing pipe 49. The air cut valve 50 opens at high engine speed with the throttle opened during normal driving or acceleration to introduce secondary air, while closing at low engine speed with the throttle closed during deceleration to cut off the secondary air.

Figure 3:
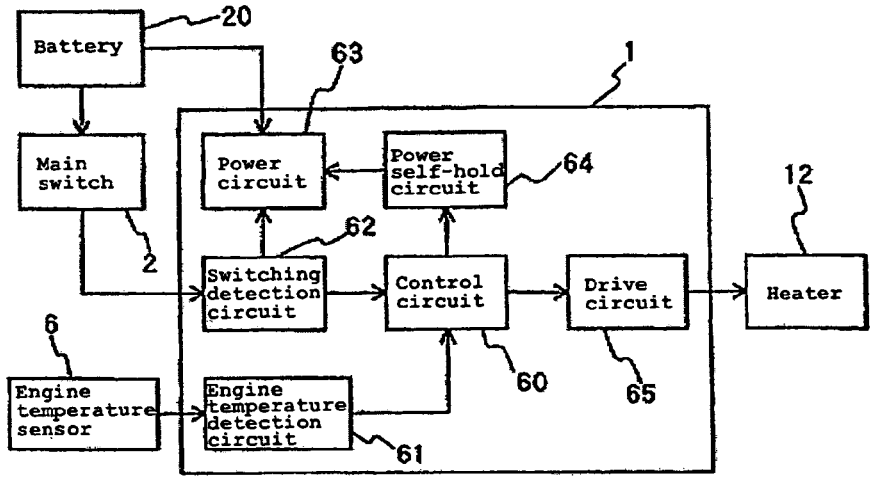
FIG. 3 is a block diagram of an auto-choke control device according to this invention.
Figure 4:
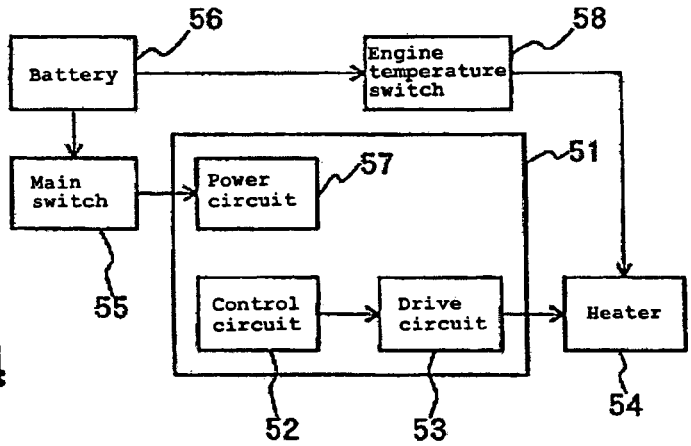
FIG. 4 is a block diagram of a conventional auto-choke control device.

FIG. 3 is a block diagram of an auto-choke control device according to an embodiment of this invention.

In the ECU 1 is provided a control circuit 60 constituting a CPU consisting of a microcomputer. The control circuit 60 is connected to a heater 12 of a hot wax type auto-choke through a drive circuit 65. A water temperature sensor (engine temperature sensor) 6 for detecting the cooling water temperature of an engine is connected to the control circuit 60 through an engine temperature detection circuit 61 consisting, for example, of an A/D converter or the like. As the engine temperature sensor, an oil temperature sensor or other sensors capable of detecting the engine temperature may be used in place of the water temperature sensor 6.

The battery 20 is connected directly to a power circuit 63. In the ECU 1 is provided a switching detection circuit 62 for detecting ON/OFF of the main switch 2, which sets the power circuit 63 ON/OFF through ON/OFF of the main switch and is connected to the control circuit 60. The control circuit 60 has a power self-hold circuit 64. The self-hold circuit 64 is connected to the power circuit 63 and supplies drive power from the battery 20 to portions even after the main switch 2 is turned OFF.

In the foregoing arrangement, before engine starting, the heater 12 is in an OFF state and the valve of the auto-choke is opened.

If the main switch 2 is turned ON at the time of engine starting, the power circuit 63 supplies drive power from the battery 20 to the control circuit 60 through an ON signal from the switching detection circuit 62 and also supplies drive power from the battery 20 to other electronic control parts and electric circuits or the like. At this time, the control circuit 60 increases the amount of intake air and enhances startabiity with the heater 12 kept in an OFF state and the valve opened. If the engine is started, the control circuit 60 sets the heater 12 ON and closes the valve gradually so as to shut off volume increase of intake air, and performs fuel injection by ordinary running control.

When the main switch 2 is turned OFF and the engine is stopped, the switching detection circuit 62 detects this condition and the self-hold circuit 64 holds power to the control circuit 60, so that operation of the control circuit 60 is continued. Therefore, after the main switch 2 is turned OFF, the heater 12 is not set OFF immediately but it is maintained in an ON state until the cooling water temperature detected by the engine temperature detection circuit 61 falls to give value or lower.

Therefore, if after the main switch 2 is turned OFF to stop the engine, the main switch is turned ON to restart the engine before the engine temperature falls, the heater 12 is in an ON state and the valve is closed, so that no amount of intake air is increased, effecting a smooth starting movement at high temperature.

Even if engine stall happens and the engine is stopped while the main switch 2 is in an ON state, the heater 12 is maintained in an ON state without any condition change.

When the engine detection circuit 61 detects the fact that the engine temperature falls to a given value or lower because of engine stoppage, the control circuit 60 sets the heater 12 OFF to open the valve and shuts off power which is being automatically held.

The control circuit 60 forces the heater 12 to be set OFF and power to be automatically shut off after a lapse of a predetermined time after the main switch 2 is turned OFF and self-holding of power is started.

INDUSTRIAL USABILITY

As described above, in this invention, when the main switch is changed to an OFF state and the engine is stopped, power to the control circuit is automatically held, so that control of the auto-choke operation can be continued by the control circuit. Therefore, the auto-choke can be maintained by the control circuit in a state in which it has been before engine stoppage until the engine temperature detected by the temperature detection means falls to a given value or lower. As a result, if the engine is restarted while the engine temperature is high after the engine stoppage, an opening state of the auto-choke can be avoided, preventing a drop in startability. Such temperature detection means (for example, a cooling water temperature sensor) is provided originally for the drive control of the fuel injection engine, and the switching detection circuit and the self-hold circuit can be easily incorporated in the same unit (ECU) as the control circuit, with a simple construction and without need of increasing its shape. Therefore, the auto-choke can be controlled properly at the time of restarting of the engine for the enhancement of startability, without need of using an expensive thermostat provided separate from a control circuit unit and having a complex construction around the engine as in the prior art, and with a small sized simple construction.

The invention claimed is:

1. An auto-choke control device having engine temperature detecting means connected to a control circuit and adapted to be drivably controlled through said control circuit in response to the engine temperature, said auto-choke control device characterized in that a switching detection circuit for detecting ON or OFF operation of said main switch is connected to said control circuit and a self-hold circuit is provided for automatically holding power to said control circuit and maintaining a heater in an ON state when said main switch is changed from an ON state to an OFF state and an engine is stopped.

2. The auto-choke control device as set forth in claim 1, wherein said auto-choke is a hot wax type auto-choke having wax expanding or contracting according to ON or OFF operation of said heater and said heater is adapted to be drivably controlled by said control circuit.

3. An auto-choke control device as set forth in claim 1 or 2, wherein said control circuit automatically shuts off power after a lapse of a predetermined time after said main switch is changed to an OFF state.

* * * * *